US007186018B2

(12) United States Patent
Burak

(10) Patent No.: US 7,186,018 B2
(45) Date of Patent: Mar. 6, 2007

(54) FUEL PROCESSING DEVICE HAVING MAGNETIC COUPLING AND METHOD OF OPERATING THEREOF

(75) Inventor: Stephen R. Burak, Middlesex, NJ (US)

(73) Assignee: Ashland Licensing and Intellectual Property LLC, Dublin, OH (US)

( * ) Notice: Subject to any disclaimer, the term of this patent is extended or adjusted under 35 U.S.C. 154(b) by 0 days.

(21) Appl. No.: 10/430,261

(22) Filed: May 7, 2003

(65) Prior Publication Data

US 2004/0223406 A1 Nov. 11, 2004

(51) Int. Cl.
*B01F 13/08* (2006.01)

(52) U.S. Cl. ..... 366/273; 366/348

(58) Field of Classification Search ..... 366/273, 366/274; 417/420, 44.1
See application file for complete search history.

(56) References Cited

U.S. PATENT DOCUMENTS 1,489,786 A * 4/1924 Povey et al. ..... 366/263
2,749,053 A * 6/1956 Rieth ..... 241/162
2,885,126 A * 5/1959 Hudson ..... 222/333
3,195,867 A * 7/1965 Mould, Jr. ..... 366/305
3,284,056 A * 11/1966 McConnaughay ..... 366/192
3,411,450 A * 11/1968 Clifton ..... 417/420
3,744,763 A * 7/1973 Schnoring et al. ..... 366/303
3,877,844 A * 4/1975 Klaus et al. ..... 417/420
3,941,517 A * 3/1976 Miyahara ..... 417/420
4,013,384 A * 3/1977 Oikawa ..... 417/368
4,294,549 A * 10/1981 Thompson et al. ..... 366/263
4,333,611 A * 6/1982 Zucker et al. ..... 241/1
4,434,944 A * 3/1984 Bodine ..... 241/258
4,834,628 A * 5/1989 Laing ..... 417/420
4,874,300 A * 10/1989 Laing et al. ..... 417/420
5,017,102 A * 5/1991 Shimaguchi et al. ..... 417/420
5,160,246 A * 11/1992 Horiuchi ..... 417/365
5,201,642 A * 4/1993 Hinckley ..... 417/420
5,248,245 A * 9/1993 Behnke et al. ..... 417/366
5,253,986 A * 10/1993 Bond et al. ..... 417/420
5,464,333 A * 11/1995 Okada et al. ..... 417/420
5,466,064 A * 11/1995 Hudson ..... 366/132
5,622,650 A * 4/1997 Rourke ..... 516/9
5,641,275 A * 6/1997 Klein et al. ..... 417/420
5,708,313 A * 1/1998 Bowes et al. ..... 310/90.5
5,779,456 A * 7/1998 Bowes et al. ..... 417/420
5,961,301 A * 10/1999 Wasserman et al. ..... 417/420
6,363,918 B2 * 4/2002 Hakansson et al. ..... 123/509

(Continued)

FOREIGN PATENT DOCUMENTS

EP 0675328 B1 9/1995

(Continued)

OTHER PUBLICATIONS

Derwent patent family report and Abstract for DE 4142891.

(Continued)

*Primary Examiner*—Tony G. Soohoo
(74) *Attorney, Agent, or Firm*—Connolly Bove Lodge & Hutz LLP

(57) ABSTRACT

A fuel processing device has a magnetic coupling that transfers rotational energy from a motor to a fuel homogenizer. The magnetic coupling has magnetic members that may be isolated from contact with fuel.

15 Claims, 3 Drawing Sheets

U.S. PATENT DOCUMENTS

| | | | | |
|---|---|---|---|---|
| 6,443,710 | B1 * | 9/2002 | Tatsukami et al. | 417/365 |
| 2003/0193834 | A1 | 10/2003 | Stache | |

FOREIGN PATENT DOCUMENTS

| | | | |
|---|---|---|---|
| EP | 1148277 | A2 | 10/2001 |
| WO | WO-92/11212 | A1 | 7/1999 |

OTHER PUBLICATIONS

Derwent patent family report and Abstract for DE 4041005.

Maag Pump Systems Textron Inc., "Maag Gear Pumps With Integral Heating Jacket For Industrial Applications And Processes", Maag Pump Systems Textron Internet Brochure, Nov. 1, 2001, 2 pgs.

* cited by examiner

FUEL PROCESSING DEVICE HAVING MAGNETIC COUPLING AND METHOD OF OPERATING THEREOF

BACKGROUND

1. Technical Field

The technical field is fuel systems. More particularly, the technical field includes methods and devices for increasing the homogeneity of fuel, fuel mixtures, and fuel-water mixtures.

2. Related Art

Conventional fuel homogenizers are designed to shear asphaltenes and to blend them into heavy fuel oil. Asphaltenes are dense carbon particles that form sludge in fuel storage tanks and in fuel handling systems. Asphaltenes clog fuel filters and require excessive waste disposal. In the combustion end of a system, asphaltenes result in incomplete combustion of fuel.

Conventional fuel homogenizers include mechanical seals, and also have temperature and pressure operating limits. If the operating limits are exceeded, or if a fuel homogenizer is not properly maintained, hot fuel may leak past the mechanical seal. The fuel may damage shaft bearings and other components, as well as create an environmentally hazardous condition.

SUMMARY

According to a first embodiment, a fuel processing device comprises a fuel homogenizer and a coupling. A motor may be provided to provide rotational energy to the coupling. The fuel homogenizer comprises a stator, a rotor mounted rotatably with respect to the stator, wherein a gap exists between the rotor and the stator, an inlet in fluid communication with the gap between the rotor and the stator, and an outlet in fluid communication with the gap. The coupling comprises a drive rotor having a first magnetic member, a driven rotor having a second magnetic member, and a shaft rotatably mounted about its longitudinal axis, wherein the shaft is rotatably coupled to the rotor of the homogenizer and to the driven rotor of the coupling. When rotational energy is provided to the coupling, the first magnetic member transfers rotary motion of the drive rotor to the second magnetic member, thereby rotating the driven rotor.

According to the first embodiment, the magnetic members may be isolated from contact with fuel, which may damage or degrade the magnetic members.

Also according to the first embodiment, fuel may circulate over the driven rotor to cool and lubricate components of the fuel processing device. The fuel processing device is also capable of operating at higher temperatures than conventional devices.

Those skilled in the art will appreciate the above stated advantages and other advantages and benefits of various embodiments of the invention upon reading the following detailed description of the embodiments with reference to the below-listed drawings.

According to common practice, the various features of the drawings are not necessarily drawn to scale. Dimensions of various features may be expanded or reduced to more clearly illustrate the embodiments of the invention.

BRIEF DESCRIPTION OF THE DRAWINGS

The detailed description will refer to the following drawings, wherein like numerals refer to like elements, and wherein.

DETAILED DESCRIPTION

Figure 1:
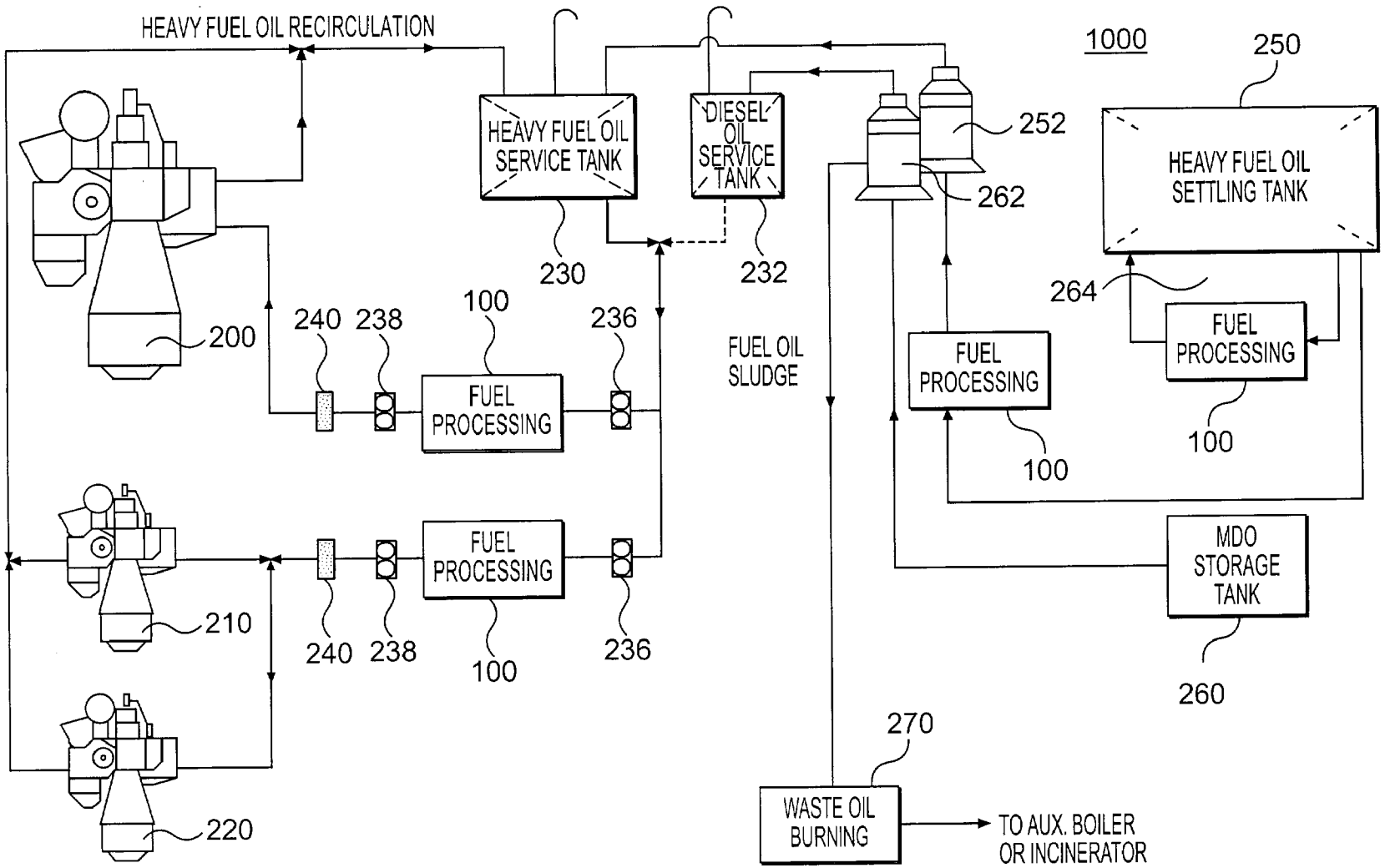
FIG. 1 is a schematic view of a power system incorporating fuel processing devices according to the present invention.

FIG. 1 is a schematic diagram of a power system 1000 in which fuel processing devices 100 may be used to process fuel in the system 1000. The power system 1000 can be, for example, a propulsion system for marine vessels.

The power system 1000 may comprise a main engine 200 and auxiliary engines 210, 220. Heavy fuel oil is held in a heavy fuel oil service tank 230, and diesel oil is held in a diesel oil service tank 232. The heavy fuel oil and the diesel oil are mixed and supplied to supply pumps 236. The supply pumps 236 send the fuel to fuel processing devices 100. After processing in the fuel processing devices 100, the fuel can be supplied to the respective engines 200, 210, 220 by circulating pumps 238. The fuel may also be filtered through filters 240.

A heavy fuel oil settling tank 250 provides heavy fuel oil to the heavy fuel oil service tank 230 through a purifier 252. A fuel processing device 100 can be in series with the purifier 252 to process fuel from the heavy fuel oil settling tank 250. A sludge reduction loop 264 can also be included in which fuel is processed in a processor 100 and returned to the heavy fuel oil settling tank 250. Diesel oil may be provided to the diesel oil service tank 232 from a marine diesel oil (MDO) storage tank 260 after passing through a purifier 262.

A waste oil burning system 270 may be included in the system 1000 to dispose of waste oil. The waste oil can be disposed of by, for example, burning in an auxiliary boiler or an incinerator (not shown). Waste from the purifiers 252, 262 can be disposed of by the waste oil burning system 270.

The system 1000 includes fuel processing devices 100 for processing various fuels, fuel mixtures and fuel-water mixtures. The fuel processing device 100 is illustrated in further detail in FIGS. 2 and 3.

Figure 2:
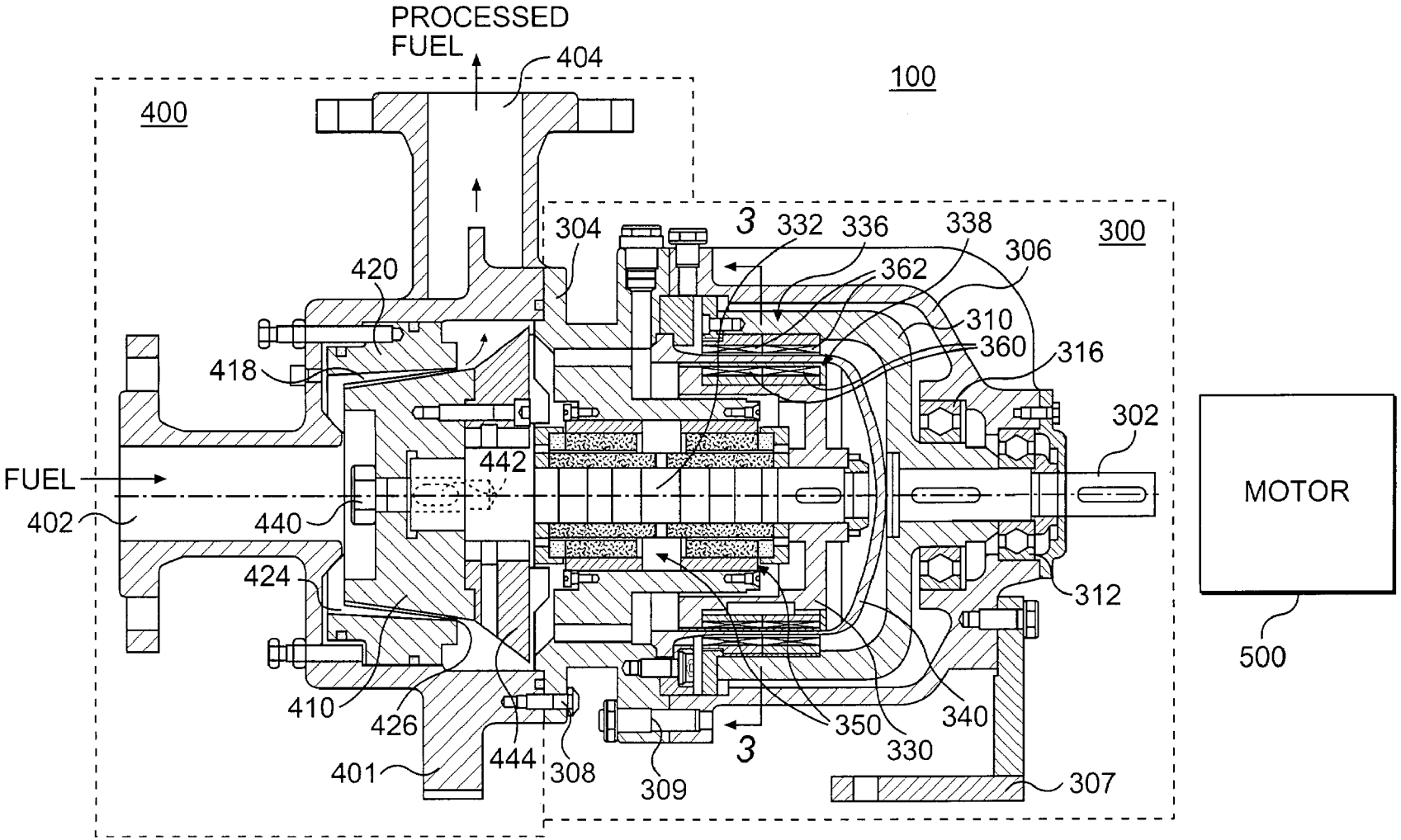
FIG. 2 is a sectional view in front elevation of a fuel processing device according to the present invention.
Figure 3:
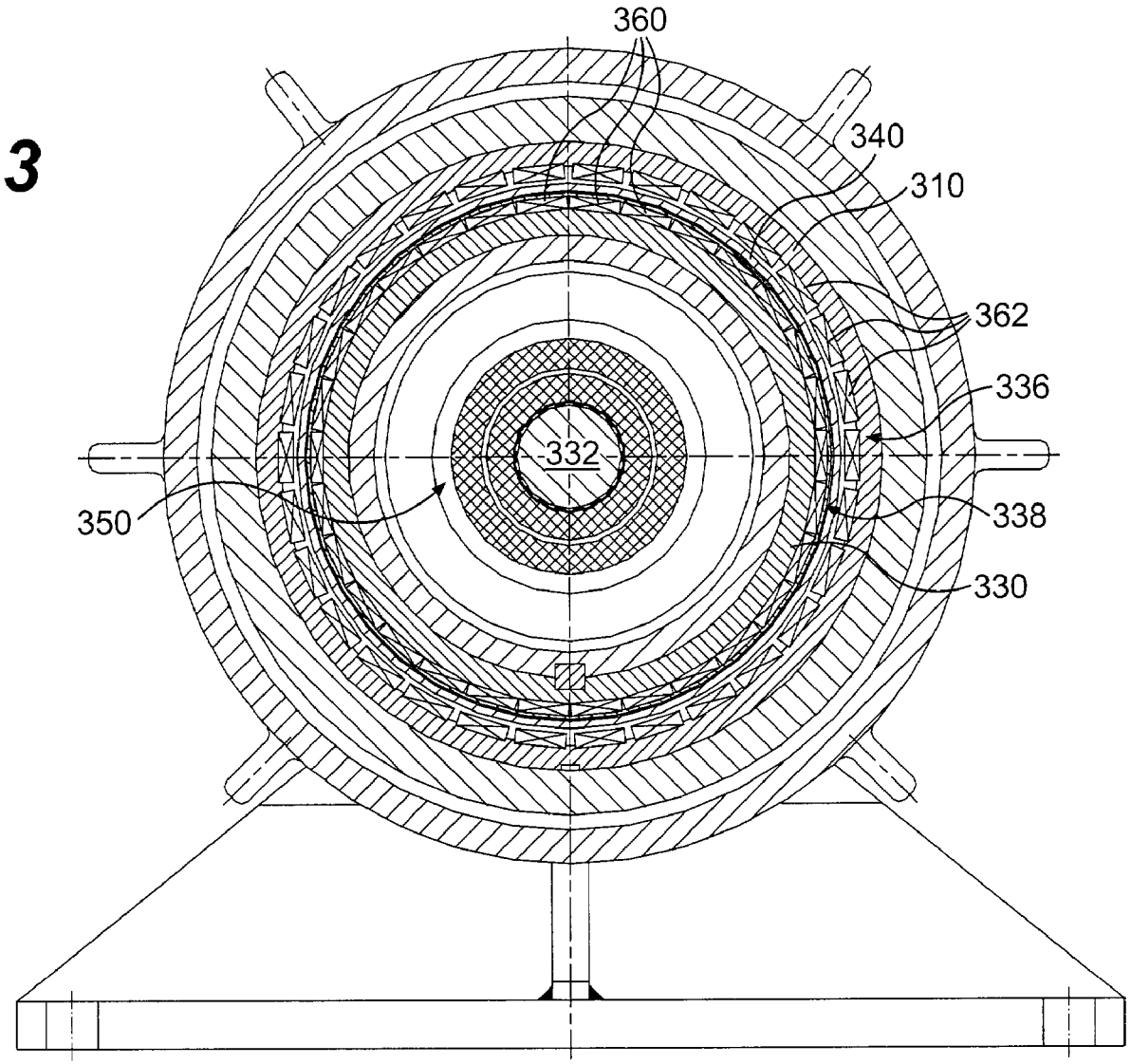
FIG. 3 is a sectional view taken on line 3—3 in FIG. 2.

FIG. 2 is a sectional view of the fuel processing device 100 in front elevation. FIG. 3 is a sectional view of the fuel processing device 100 taken on line 3—3 in FIG. 2. The fuel processing device 100 comprises a coupling 300, a fuel homogenizer 400, and a motor 500. The fuel homogenizer 400 receives fuel, a fuel mixture or a fuel-water mixture at an inlet 402 and outputs processed fuel at an outlet 404. The incoming fuel may be comprised of a single fuel type, or of a mixture of two or more fuels, a mixture of fuel and water, or any of the aforementioned in combination with fuel additives. For the purposes of this specification, the incoming fuel and/or fuel mixtures may be referred by the general term "fuel." The term "fuel" is also used with the understanding that the fuel may be a fuel-water mixture and may contain other additives.

The motor 500 provides the rotational energy to operate the homogenizer 400. The motor 500 is rotatably coupled to the homogenizer 400 by the coupling 300. The coupling 300 is coupled to the motor 500 by a shaft 302. The connection of the shaft 302 to the motor 500 may be conventional, and is therefore not illustrated.

The homogenizer 400 comprises a housing 401, and a conical rotor 410 concentrically and rotatably mounted within a conical stator 420. Incoming fuel enters the inlet 402 in the direction indicated by the arrows, and passes through a rotor/stator gap inlet 424. In one embodiment, the rotor/stator gap inlet 424 may have a width, measured in a direction perpendicular to the centerline of the homogenizer 400, of about 3.0 mm. Other gap inlet widths may also be used depending upon the application. The rotor 410 and the stator 420 have differing tapers, resulting in a progressively narrowing gap 418 between the rotor 410 and the stator 420. As shown by the arrows in FIG. 2, the fuel travels into the progressively narrowing gap 418 between the rotor 410 and the stator 420, and exits through a rotor/stator gap outlet 426. The rotor/stator gap outlet 426 may have an adjustable width, as measured along a direction parallel to the centerline of the homogenizer 400. The rotor/stator gap outlet 426 may have a width range of, for example, about 0.15–0.3 mm. Other widths may be used depending upon the homogeneity desired for the processed fuel and the types of fuel being processed.

As the fuel travels into the narrowing gap 418, asphaltenes in the fuel are sheared between the opposed rotor 410 and stator 420 surfaces. The homogenizer 400 also acts to mix differing fuel types comprising the incoming fuel, if a plurality of fuel types are present in the incoming fuel. Water and/or additives, if present, are also mixed within the fuel. The degree of homogeneity in the incoming fuel is thereby increased by the homogenizer 400.

The coupling 300 transfers rotary energy from the motor 500 to the homogenizer 400. The coupling 300 is magnetic and provides several advantages over conventional coupling devices. The coupling 300 is described in detail below.

The coupling 300 comprises a bearing housing 304 and a bearing bracket 306. The coupling 300 may include a bracket 307 for mounting the coupling 300 to an exterior surface, such as a deck plate in marine applications. The bearing housing 304 is coupled to the homogenizer 400 by a plurality of bolts 308 arranged around the periphery of the bearing housing 304. Only one bolt 308 is illustrated in FIG. 2. The bearing housing 304 is coupled to the bearing bracket 306 by bolts 309 arranged around the periphery of the bearing bracket 306 (only one bolt 309 is illustrated).

In the coupling 300, a drive rotor 310 is magnetically coupled to a driven rotor 330. The drive rotor 310 receives rotational energy from the motor 500, and transfers the rotational energy to the driven rotor 330 via the magnetic coupling. The drive rotor 310 is coupled to the shaft 302, which is in turn coupled to the motor 500. The shaft 302 is supported by a bearing 312 in the bearing bracket 306, and the drive rotor 310 is supported by a bearing 316 in the bearing bracket 306. The bearings 312, 316 may be, for example, ball bearings.

The driven rotor 330 includes a shaft 332 which is coupled to the rotor 410 of the homogenizer 400. The shaft 332 may be coupled to the rotor 410 by, for example, a bolt 440 having a keyway 442. A key is inserted in the keyway 442 to ensure that the shaft 332 and the rotor 410 rotate together. The rotor 410 therefore rotates with the driven rotor 330 of the coupling 300.

The magnetic coupling is created by the interaction of the magnetic fields from an outer magnetic member 336 and an inner magnetic member 338. The outer magnetic member 336 is connected to the drive rotor 310, and the inner magnetic member 338 is connected to the driven rotor 330. The magnetic members 336, 338 may be comprised of permanent magnets mounted as a ring. The inner magnetic member 338 ring may be comprised of a bank of magnets 360, and the outer magnetic member 336 ring may be comprised of bank of magnets 362. Each of the magnetic members 336, 338 may preferably be in the form of two separate rings of magnets. The shape and arrangement of the magnetic members 336, 338 are discussed in further detail below with reference to FIG. 3. The magnetic members 336, 338 create a multipolar magnetic coupling, which transfers rotational energy of the drive rotor 310 through a containment shell 340 of the coupling 300.

The containment shell 340 is located within the drive rotor 310. The containment shell 340 is stationarily connected to the bearing housing 304, and does not rotate with the driven rotor 330. The containment shell 340 may be connected to the bearing housing 304 with a gasket (not shown) located between the containment shell 340 and the bearing housing 304 to form a sealed housing or chamber within the containment shell 340. The containment shell 340 may be made from materials such as, for example, ceramic and stainless steel.

Fuel may circulate within the containment shell 340. The fuel may enter the containment shell 340 by passing over the periphery of an outlet disk 444 of the homogenizer 400. Fuel circulating within the containment shell 340 cools and lubricates the components within the containment shell 340. For example, the shaft 332 can be mounted in sleeve bearings 350, which are lubricated and cooled by the circulating fuel. Sleeve bearings are preferable to conventional roller bearings which would occupy a larger volume within the coupling 300. The sleeve bearings may be made from materials such as, for example, carbide steel.

The inner magnetic member 338 is enclosed in the driven rotor 330 and is isolated from fuel flowing in the coupling 300. The outer magnetic member 336 is also isolated from contact with fuel, because fuel does not enter the space between the containment shell 340 and the drive rotor 310.

In operation, the motor 500 rotates the shaft 302, which rotates the drive rotor 310. The outer magnetic member 336 is magnetically coupled to the inner magnetic member 338, and thereby causes the driven rotor 330 to rotate. The shaft 332 is rotatably coupled to the driven rotor 330, and rotates with the driven rotor 330. The rotor 410 of the homogenizer 400 is coupled to the shaft 332, and rotates at the same angular rate as the shaft 332. As fuel enters the inlet 402 of the homogenizer 400, it is drawn into the rotor/stator inlet gap 424, and particulate matter such as asphaltenes are progressively ground and mixed by shearing forces in the narrowing gap 418. The degree of homogenization of the fuel also increases as asphaltenes are blended into the liquid fuel and as differing types of fuel, water and additives (if present) are mixed together.

The fuel passes through the rotor/stator gap outlet 426 and exits the homogenizer 400 through the outlet 404. Desirable post-processing asphaltene sizes should be less than about 5 microns in diameter. The outlet 404 may be coupled to a fuel line which may provide the processed fuel to, for example, an engine.

During operation of the fuel processing device 100, fuel may advantageously be continuously circulated through the interior of the containment shell 340. The fuel acts to cool and lubricate the components within the containment shell 340. Water may be added to the fuel prior to passing the fuel through the fuel processing device 100. The fuel processing device 100 then creates a fuel-water emulsion that, when injected into a diesel engine, results in reduced nitrous oxide ($NO_x$) emissions.

FIG. 3 is a sectional view of the coupling 300, taken on line 3—3 in FIG. 2. As shown in FIG. 3, the inner magnetic member 338 is comprised of a ring of the magnets 360 in the driven rotor 330. Referring to FIG. 2, the inner magnetic member 338 may include two such rings. The two rings may be arranged in coaxial alignment in an end-to-end fashion. Similarly, the outer magnetic ring 336 may be comprised of two coaxially aligned rings of the magnets 362.

According to the above embodiment, the magnets 360 of the inner magnetic member 338 are enclosed within the driven rotor 330, and the magnets 362 of the drive rotor 310 are open to the space between the containment shell 340 and the drive rotor 310, which is free from fuel. The magnetic members 336, 338 are therefore isolated from contact with fuel, which may damage or degrade the magnets 360, 362. Preferably, the containment shell 340 is mounted within the drive rotor 310 so that the space therebetween is hermetically sealed.

Also according to the above embodiment, fuel circulates within the containment shell 340 to cool and lubricate the components located therein. The sleeve bearings 350 are lubricated by the fuel, providing for smooth and maintenance-free operation of the coupling 300.

The fuel processing device 100 is capable of operating at very high temperatures. For example, the processing device 100 may operate at fuel temperatures of up to about 400° C. By contrast, conventional fuel homogenizers have a safe operating fuel temperature maximum value in the range of about 150–180° C.

The motor 500 may be, for example, an electric motor. One suitable electric motor is produced by ATB Motorentechnik GmbH of Nordenham Germany, having designation IM B 35 and sold under part number DE 160M-4. Other motors, such as those produced by SIEMENS Aktiengesellschaft AG Automation and Drives Group, of Erlangen Germany, may also be used. One suitable type of motor is sold under the general designation of "squirrel cage motor." The motor 500, and accordingly the homogenizer 400, may operate at a wide range of rotational speeds. For example, when processing heavy fuel oil for marine applications, rotational speeds in the range of about 1000–3000 RPM may be used. The motor 500 can, however, be selected to have any suitable speed depending upon the type of fuel to be processed, and upon the use expected for the processed fuel. The motor 500 can be detachably mounted to the shaft 302 (FIG. 2) of the coupling 300, and may be assembled as a separate element.

According to the embodiments disclosed in this specification, the homogenizer 400 may perform the functions of shearing and/or grinding particulate matter within fuel. The homogenizer 400 may also mix various fuel types, water, and additives. The term "homogenizer" does not indicate, however, that fuel processed in the homogenizer 400 must be of a completely uniform or homogeneous state. The term "homogenizer" does imply that a fuel or a mixture of fuels entering the homogenizer will have a higher degree of homogeneity after processing in the homogenizer 400.

The above power system 1000 is described as a marine powerplant. The fuel processing device 100 embodiment described above may have other applications, however. For example, the fuel processing device 100 may be used in an electrical power generating facility.

The foregoing description of the invention illustrates and describes the present invention. Additionally, the disclosure shows and describes only selected preferred embodiments of the invention, but it is to be understood that the invention is capable of use in various other combinations, modifications, and environments and is capable of changes or modifications within the scope of the inventive concept as expressed herein, commensurate with the above teachings, and/or within the skill or knowledge of the relevant art.

The embodiments described hereinabove are further intended to explain best modes known of practicing the invention and to enable others skilled in the art to utilize the invention in such, or other, embodiments and with the various modifications required by the particular applications or uses of the invention. Accordingly, the description is not intended to limit the invention to the form disclosed herein. Also, it is intended that the appended claims be construed to include alternative embodiments, not explicitly defined in the detailed description.

What is claimed is:

1. A method of processing fuel, comprising:

providing a coupling having a drive element with a first magnetic member and a driven element with a second magnetic member, the drive element being magnetically coupled to the driven element by the first and second magnetic members;

providing a fuel homogenizer having a stator and a rotor rotatably mounted with respect to the stator, wherein the rotor is rotatably coupled to the driven element of the coupling;

providing fuel to the rotor;

providing rotational energy to the drive element, the rotational energy rotating the drive element and the first magnetic member, wherein the first magnetic member transfers rotational energy to the second magnetic member and rotates the rotor; and shearing asphaltenes in the fuel with opposed surfaces of the rotor and the stator as the fuel travels through a gap extending between the rotor and the stator in a direction substantially parallel to a rotational axis of the rotor, wherein the gap progressively narrows from an inlet portion of the gap to an outlet portion of the gap.

2. The method of claim 1, wherein the drive element is rotatably mounted within a bearing bracket.

3. The method of claim 1, wherein the first magnetic member comprises at least one ring of magnets disposed on the drive element.

4. The method of claim 1, wherein:

the second magnetic member comprises at least one ring of magnets disposed on the driven element; and the second magnetic member is arranged concentrically with the first magnetic member.

5. The method of claim 1, wherein providing fuel comprises:

providing a plurality of fuel types to the homogenizer.

6. The method of claim 1, wherein providing fuel comprises:

providing a mixture of fuel and water to the homogenizer.

7. The method of claim 1, wherein providing a coupling comprises:

providing a containment shell disposed between the first and second magnetic members.

8. The method of claim 7, wherein the first magnetic member is exposed to a gap between the containment shell and the drive element.

9. The method of claim 7, wherein a gap between the containment shell and the drive element is hermetically sealed at least in part by the containment shell and the drive element.

10. The method of claim 7, wherein:

the coupling comprises a shaft rotatively coupled to the driven means and to the rotor;

an interior of the containment shell is in fluid communication with the gap extending between the rotor and the stator; and fuel flows from the homogenizer into the containment shell when the shaft rotates.

11. The method of claim 1, wherein the coupling comprises:

a shaft rotatively coupled to the driven means and to the rotor.

12. The method of claim 1, wherein the shaft is mounted in at least one sleeve bearing.

13. The method of claim 11, comprising:

coupling a motor to the shaft to provide the rotational energy to the shaft, thereby rotating the rotor.

14. The method of claim 13, comprising operating the motor in a rotational speed range of about 1000–3000 RPM.

15. The method of claim 1, wherein:

fuel from the rotor may enter an interior of the containment shell but is isolated from an exterior of the containment shell.

* * * * *